US009150326B2

(12) United States Patent
Landry

(10) Patent No.: US 9,150,326 B2
(45) Date of Patent: Oct. 6, 2015

(54) CUP HOLDER TRAY

(75) Inventor: Paul Landry, Cheraw, SC (US)

(73) Assignee: Cascades Canada ULC, Kingsey Falls, Quebec (CA)

( * ) Notice: Subject to any disclaimer, the term of this patent is extended or adjusted under 35 U.S.C. 154(b) by 851 days.

(21) Appl. No.: 13/022,484

(22) Filed: Feb. 7, 2011

(65) Prior Publication Data

US 2011/0120995 A1 May 26, 2011

Related U.S. Application Data

(63) Continuation-in-part of application No. PCT/CA2010/000654, filed on Apr. 27, 2010.

(60) Provisional application No. 61/172,917, filed on Apr. 27, 2009.

(51) Int. Cl.
*B65D 21/02* (2006.01)
*B65D 1/36* (2006.01)

(52) U.S. Cl.
CPC ..... *B65D 1/36* (2013.01)

(58) Field of Classification Search
CPC ..... B65D 71/70; B65D 21/02
USPC ..... 220/23.8; 229/407, 904, 15, 2.5; 206/564, 563, 427
See application file for complete search history.

(56) References Cited

U.S. PATENT DOCUMENTS

D236,575 S 9/1975 Vigue
D249,620 S 9/1978 Vigue
D249,622 S 9/1978 Vigue
D249,769 S 10/1978 Vigue
D250,091 S 10/1978 Jewell
D250,243 S 11/1978 Vigue
D253,561 S 12/1979 Vigue
4,208,006 A 6/1980 Bixler et al.
4,218,008 A 8/1980 Veilleux
4,381,847 A 5/1983 Bessett et al.
D274,110 S 6/1984 Vigue (Continued)

FOREIGN PATENT DOCUMENTS

CA 2060608 8/1992
CA D130703 3/2010

(Continued)

OTHER PUBLICATIONS http://web.archive.org/web/20080129082914/http://www.reliablepaper.com/Chinet_Paper_Beverage_Carrier_4_Cup_p/huhflurry.thm.

*Primary Examiner* — Anthony Stashick
*Assistant Examiner* — Raven Collins
(74) *Attorney, Agent, or Firm* — Sutherland Asbill & Brennan LLP

(57) ABSTRACT

A cup holder tray having a plurality of cup pockets for receiving beverage cups therein, a finger spacing provided between two cup pockets, and a thumb-receiving surface above the finger spacing. The thumb-receiving surface can have friction protrusion to enhance friction with the thumb. Each one of the cup pockets having a circular wall and a system of cup holding surfaces protruding inwardly from the circular wall and cooperating in holding a beverage cup to be pushed downwardly therein. At least one of the cup holding surfaces can be connected to the circular wall by a lateral wall on each side, the lateral walls having a planar section oriented roughly normal to the beverage cup during use.

30 Claims, 4 Drawing Sheets

(56) References Cited

U.S. PATENT DOCUMENTS

| | | | | | |
|---|---|---|---|---|---|
| D279,259 | S | | 6/1985 | Bixler et al. | |
| D289,010 | S | | 3/1987 | Vigue | |
| D290,580 | S | | 6/1987 | Vigue | |
| 4,718,555 | A | | 1/1988 | Amberg | |
| D302,114 | S | | 7/1989 | Ashby | |
| D302,122 | S | | 7/1989 | Ashby | |
| 4,863,451 | A | | 9/1989 | Marder | |
| D309,258 | S | * | 7/1990 | Vigue | D9/755 |
| 4,961,500 | A | | 10/1990 | Coulombe | |
| D319,579 | S | | 9/1991 | Vigue | |
| 5,096,065 | A | * | 3/1992 | Vigue | 206/564 |
| D331,008 | S | | 11/1992 | Vigue | |
| 5,316,173 | A | | 5/1994 | Emery | |
| 5,335,814 | A | | 8/1994 | Hepp | |
| 5,566,852 | A | | 10/1996 | Emery | |
| D384,275 | S | | 9/1997 | DuBois et al. | |
| 5,713,619 | A | | 2/1998 | DuBois et al. | |
| 6,076,876 | A | | 6/2000 | Letourneau et al. | |
| D436,853 | S | | 1/2001 | Sussman | |
| D438,100 | S | * | 2/2001 | Cekota | D9/755 |
| 6,398,056 | B1 | * | 6/2002 | Letourneau et al. | 220/23.8 |
| 6,679,380 | B2 | | 1/2004 | Brown | |
| 7,225,927 | B2 | | 6/2007 | Sweeney | |
| D552,488 | S | | 10/2007 | Sharma et al. | |
| D554,533 | S | * | 11/2007 | Sharma et al. | D9/755 |
| 7,506,763 | B2 | | 3/2009 | Hatcher | |
| 7,762,396 | B1 | | 7/2010 | Yang et al. | |
| 7,789,239 | B2 | | 9/2010 | Juliano | |
| 2006/0042977 | A1 | | 3/2006 | Sandel | |
| 2007/0017827 | A1 | | 1/2007 | Urquhart et al. | |
| 2008/0302691 | A1 | * | 12/2008 | Olson et al. | 206/427 |

FOREIGN PATENT DOCUMENTS

| | | |
|---|---|---|
| CA | D133856 | 3/2010 |
| CA | D133906 | 3/2010 |
| EP | 1489014 | 12/2004 |
| EP | 15104470001 | 5/2009 |
| NL | 1021257 | 2/2004 |
| WO | 2006065132 | 6/2006 |
| WO | 2010064905 | 6/2010 |
| WO | 2010124383 | 11/2010 |

* cited by examiner

CUP HOLDER TRAY

CROSS-REFERENCE TO RELATED APPLICATIONS

This is a continuation-in-part of PCT patent Application No. PCT/CA2010/000654 filed Apr. 27, 2010, now pending, which claims priority to U.S. provisional patent Application No. 61/172,917, filed Apr. 27, 2009. These applications are incorporated herein by reference in their entirety.

BACKGROUND

Cup trays have been known for decades and are commonly used when a consumer purchases more than one beverage, to allow the consumer to handle all the beverages (typically up to four) at once. Further, it is a common design requirement for such cup trays that their structure be appropriate for handling with a single hand when loaded, while leaving the other hand free. The cup trays can also be conveniently laid on a flat surface, such as a seat of a car to carry the beverages to a place of consumption. Cup trays are typically intended to be disposed of after use, and there is therefore a strong market pressure for their costs to be maintained as low as possible. It is common that such trays be made of moulded pulp, although other materials have been used as well. Trays having four cup pockets are the most common, and are typically provided in a generally square shape with one cup pocket adjacent each corner.

Although known cup trays were satisfactory to a certain degree, there still remained room for improvement. For instance, there was strong market demand to improve or maintain the cup retention strength, make them capable of handling a wider variety of sizes, make them easier to handle, while maintaining their costs highly competitive.

SUMMARY

The cup tray has a cup holding system having a plurality of cooperating cup holding surfaces which project inwardly from an outer wall of the cup pocket. In accordance with one aspect, the cup-holding system was improved. Lateral walls now connect the cup holding surfaces to the outer wall on each side thereof, the lateral walls having a flat section which is oriented substantially normal to a beverage cup received in the cup pocket.

In accordance with one aspect, there is provided a cup holder tray having a body of moulded pulp with a plurality of cup pockets for receiving beverage cups therein, and a rim surrounding the plurality of cup pockets, the cup pockets projecting downwardly relative to the rim, each one of the cup pockets having a bottom parallel to the rim, and at least three wall sections extending upwardly from the bottom and at least three cup holding surfaces circumferentially interspersed between the at least three wall sections and protruding inwardly therefrom, the cup holding surfaces cooperating in holding a beverage cup to be pushed downwardly against the bottom, the cup holder tray being characterized in that at least one of the cup holding surfaces is connected to adjacent wall sections on each side by a corresponding lateral wall having a substantially planar section.

In an embodiment, the planar section is oriented substantially normal to the beverage cup.

In an embodiment, each cup holding surface has an upper edge connected to a horizontal surface to which the flat sections of the two corresponding lateral walls are also connected.

In an embodiment, the cup holding surfaces have a free lower edge separated from the bottom by a gap extending under their entire width and under the lateral walls.

In an embodiment, the height of cup holding surfaces is greater than the height of the gap. The cup holding surfaces can be split into two halves by a slot extending upwardly from the gap and can be inwardly inclined relative to an upper edge.

In an embodiment, the planar section has a lower free end outwardly inclined relative to a top end.

In an embodiment, the wall sections connect the bottom to a horizontal surface at the height of the rim.

In an embodiment, all the cup holding surfaces are connected by the lateral walls having a substantially planar section.

In accordance with another aspect, there is provided a cup holder tray having a plurality of cup pockets for receiving beverage cups therein, each one of the cup pockets having an outer periphery and a bottom and at least three cup holding surfaces protruding inwardly from the outer periphery and cooperating in holding a beverage cup which is inserted into the cup pocket and placed into abutment against the bottom, the cup holding surfaces having a free lower edge being inwardly inclined relative an upper edge, and being resilient in a manner to be pushed outwardly by the beverage cup as it is inserted into the cup pocket and thereafter exert a reactive pushing force against the positioned beverage cup; the cup holder tray being characterized in that each one of the at least three cup holding surfaces has two opposite lateral walls on each side thereof, and that the lateral walls have a flat section which is substantially normal to the beverage cup when inserted in the cup pocket.

In an embodiment, the flat sections each have a free lower end outwardly inclined relative to a top end. The free lower end can be oriented slightly inwardly relative to the center of the cup pocket, the orientation of the free lower end being moved slightly outwardly relative to the center of the cup pocket when the beverage cup is inserted in the cup pocket. The free lower end of the flat sections can be oriented substantially horizontally.

In an embodiment, the upper edge of cup holding surfaces and the upper end of flat section are connected to a common horizontal surface.

In an embodiment, the outer periphery of the cup pockets interconnects the bottom to a rim of cup holder tray.

In an embodiment, the cup holding surfaces are split into two halves by a vertical slot.

In an embodiment, the height of cup holding surfaces is greater than a height separating lower edge of the cup holding surfaces from the bottom. The height of cup holding surfaces can be at least twice the height separating lower edge of the cup holding surfaces from the bottom.

In an embodiment, the cup holding surfaces are inclined inwardly relative to the upper edge by more than 15 degrees, preferably between 15 and 25 degrees.

In an embodiment, the flat section is inclined relative its upper end by more than 10 degrees, preferably between 15 and 20 degrees.

In accordance with another aspect, there is provided a cup holder tray comprising a body made of moulded pulp having four cup pockets projecting downwardly relative to the rim, four edges and four corners, each one of the cup pockets being positioned adjacent a corresponding one of the corners and having a bottom parallel to the rim, and at least three wall sections extending upwardly from the bottom and at least three cup holding surfaces circumferentially interspersed between the at least three wall sections, protruding inwardly therefrom, and connected thereto by lateral walls on both sides, the cup holding surfaces cooperating in holding a beverage cup pushed downwardly against the bottom of the corresponding cup pocket; and adjacent each one of the edges, a corresponding spacing provided underneath the tray between two corresponding ones of the pockets, in which a user can place his fingers and support the tray; and above each one of the spacings, above the tray, a corresponding thumb-receiving surface against which the user can apply his thumb, in opposition with his fingers in the corresponding spacing; wherein for each one of the four cup pockets, one of the cup holding surfaces is an outer holding surface and has an upper end connected to the rim and later walls on both sides connecting the outer holding surface to the wall sections, and two of the cup holding surfaces are inner holding surfaces having an upper end connected to a corresponding thumb receiving surface; wherein at least one of the cup holding surfaces is connected to adjacent wall sections on each side by a corresponding lateral wall having a substantially planar section.

In an embodiment, the outer holding surface is connected to adjacent wall sections on each side by corresponding lateral walls each having a substantially planar section.

In an embodiment, all of the cup holding surfaces are connected to adjacent wall sections on each side by corresponding lateral walls each having a substantially planar section.

In an embodiment, the planar sections are substantially normal to the beverage cup.

In an embodiment, the cup holding surfaces are straight along their length, have a free lower edge inclined towards the beverage cup, an upper edge connected to a horizontal surface, and are split into two halves by a vertical slot.

In accordance with another aspect, there is provided a cup holder tray having a plurality of cup pockets for receiving beverage cups therein, each one of the cup pockets having a circular wall and at least three cup holding surfaces protruding inwardly from the circular wall and cooperating in holding a beverage cup to be pushed downwardly therein, the cup holder tray being characterized in that at least one of the cup holding surfaces is connected to the circular wall by a lateral wall on each side, the lateral walls having a planar section oriented roughly normal to the beverage cup during use.

In accordance with another aspect, it is sought to shape such cup holder trays in a manner to facilitate the ease of manipulation by the user. For instance, it is know known to shape the cup holder trays in a manner that on each of the four sides, a spacing is left underneath the tray, between two adjacent pockets, so that a user can place his fingers and thereby support the tray. It is also know to provide a protruding flat surface area above the tray, in opposition with the spacing underneath, so that a user can apply his thumb thereon, in opposition with his fingers, and thereby firmly clasp the tray to reduce the likelihood of dropping the tray and the carried beverages.

It was found that an even firmer grip could be achieved when the thumb area was provided with a number of protrusions, preferably in the form of gripping ribs, preferably parallel to the edge of the tray. This even further reduced the likelihood of dropping the tray and thereby represents an asset for consumer satisfaction.

In accordance with one aspect, there is provided a cup holder tray comprising a body made of moulded pulp, having four edges and four corners, and four cup pockets, each cup pocket being positioned adjacent a corresponding one of the corners; and adjacent each one of the edges, a corresponding spacing provided underneath the tray, between two corresponding ones of the pockets, in which a user can place his fingers and support the tray; and above each one of the spacings, above the tray, a corresponding thumb-receiving surface against which the user can apply his thumb, in opposition with his fingers in the corresponding spacing; the thumb receiving surface having a plurality of protruding ribs providing additional friction against the thumb, the ribs being parallel to one another, elongated, and disposed parallel to the corresponding edge; wherein the moulded pulp body has a sufficient amount of structural resistance to maintain its structural integrity when four beverages are inserted into corresponding ones of the four cup pockets and the tray with the beverages are being carried by the thumb and fingers of the user, with a single hand.

In accordance with another aspect, there is provided a cup holder tray having a body made of moulded pulp, having four edges and four corners, and four cup pockets, each cup pocket being positioned adjacent a corresponding one of the corners, and adjacent each one of the edges, a corresponding spacing provided underneath the tray, between two corresponding ones of the pockets, in which a user can place his fingers and support the tray; and above each one of the spacings, above the tray, a corresponding thumb-receiving surface against which the user can apply his thumb, in opposition with his fingers in the corresponding spacing; CHARACTERIZED IN THAT the thumb receiving surface has a plurality of protruding ribs providing additional friction against the thumb, the ribs being parallel to one another, elongated, and disposed parallel to the corresponding edge.

In accordance with another aspect, there is provided a cup holder tray having a plurality of cup-holding pockets projecting downwardly from the tray, and at least one lateral edge adjacent two of the cup-holding pockets, the two of the cup-holding pockets being spaced apart from one another along the edge, with a finger spacing therebetween configured for receiving fingers of a user underneath the tray, and a thumb-receiving surface above the finger spacing and spaced from the edge, configured for receiving a thumb of the user above the tray, in opposition with the fingers, the thumb-receiving portion having a plurality of upwardly protruding ribs.

In accordance with still another aspect, there is provided a cup holder tray having a plurality of downwardly projecting cup pockets, a finger spacing provided between two cup pockets, and a thumb-receiving surface above the finger spacing, the thumb receiving portion having at least three upwardly oriented protrusions.

In an embodiment, the ribs of the cup holder tray are elongated, parallel to one another, and parallel to the corresponding edge and the plurality of ribs includes at least three ribs and, in a particular embodiment, between three and five ribs. The ribs can protrude upwardly by between 0.050 and 0.125 inches. The ribs can be equally interspaced from one another. The ribs can be interspaced by a distance corresponding to their width and, in a particular embodiment, the ribs have about ⅛ inches in width.

In an embodiment, the thumb-receiving surface is spaced from the edge of the tray.

In an embodiment, a structural portion having a plurality of steps oriented parallel to the edge is provided between the thumb-receiving surface and the edge of the tray.

For the sake of clarity and simplicity, the directions up and down, or above and below, horizontal and vertical, are used herein in reference to the orientation in which the cup-holder tray is used when beverages are carried in it, i.e. where the cup-holder tray is oriented horizontally.

DESCRIPTION OF THE FIGURES

In the appended figures.

DETAILED DESCRIPTION

Figure 1:
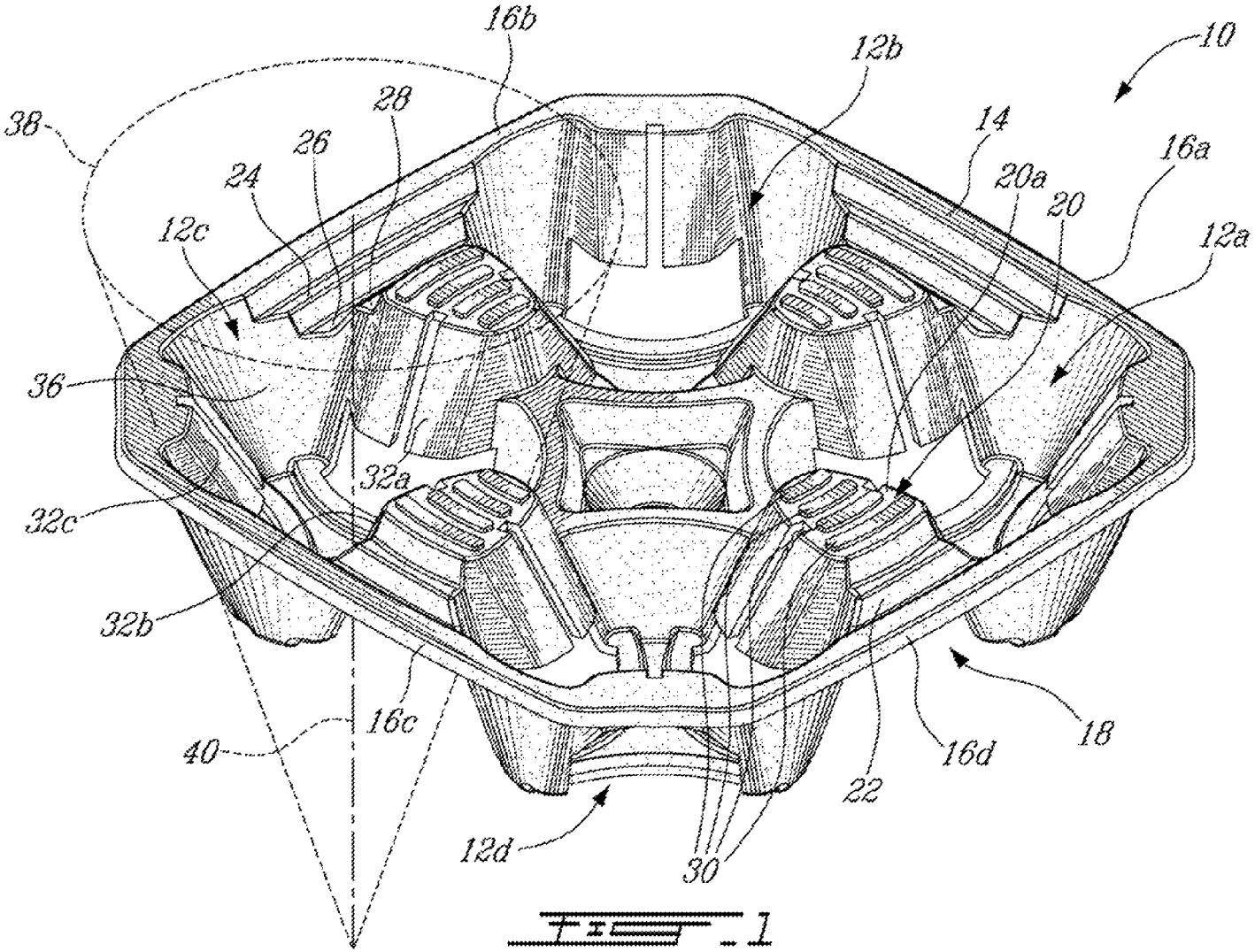
FIG. 1 is an isometric view of an example of a cup-holder tray in accordance with a first embodiment.

In FIG. 1, an example of a cup-holder tray 10 is shown. In this embodiment, the cup-holder tray 10 is designed with four cup pockets 12*a*, 12*b*, 12*c*, 12*d* arrayed in a square configuration, and is made of moulded pulp. Moulded pulp is particular in that it can be moulded in a thickness which corresponds to a desired compromise between firmness and flexibility. In this case, the cup-holder tray 10 is designed with a generally square rim 14, having four lateral edges 16*a*, 16*b*, 16*c*, 16*d* and four truncated corners. The four cup pockets 12*a*, 12*b*, 12*c*, 12*d*, project downwardly from a plane corresponding to the rim 14. Each one of the cup pockets 12*a*, 12*b*, 12*c*, 12*d* is associated with a corresponding corner. In this embodiment, the cup-holder tray 10 is symmetrical, and all four sides and pockets 12*a*, 12*b*, 12*c*, 12*d* are identical. It will be understood that the cup-holder tray 10 can be grabbed and handled by any one of the four edges 16*a*, 16*b*, 16*c*, 16*d*.

Along any one 16*d* of the edges, between two corresponding ones 12*a*, 12*d* of the downwardly projecting cup pockets, there is a finger spacing 18 in which the user can insert his fingers to support the weight of the cup-holder tray 10 and of any beverages which can be carried inside the cup pockets 12*a*, 12*b*, 12*c*, 12*d*. On top of the cup-holder tray 10, opposite the finger spacing 18, there is a thumb-receiving surface 20 which is provided for receiving the thumb of a user in opposition with his fingers which are inserted underneath, so the user can firmly hold the tray 10 when beverages are carried therein.

In this embodiment, the thumb-receiving surface 20 has a horizontal flat island surface 20*a* which is spaced-apart from the edge 16*d* of the tray 10 by roughly 1 to 3 inches (for illustrative purposes, the illustrated cup tray 10 has an overall width of between 8 and 9 inches in this embodiment). This spacing, combined with the selected length of the thumb-receiving surface 20, allows the tray to be manipulated by adult users having different hand sizes in a relatively satisfactory manner. Further, in this embodiment, a structural portion 22 having a step-like shape including the rim 14, a lower step 24, a bottom step 26, another lower step 28, and the thumb receiving surface 20, is provided between the thumb-receiving surface 20 and the edge 16*d* of the tray 10, this structural portion 22 helps providing structure to the tray 10 to support a load of beverages.

It was found that an even better grip could be achieved by the user with the thumb-receiving surface 20 provided with frictional protrusions such as ribs 30. In the illustrated embodiment, for instance, each one of the thumb-receiving surfaces 20 has a plurality of ribs 30. The ribs 30 are elongated, parallel to one another, interspaced from one another, and generally parallel to the edge 16*d* of the tray 10. The ribs 30 offer frictional resistance to counter a sliding effect which can otherwise be felt by a thumb handling a loaded tray, in the direction of the edge 16*d* of the tray 10.

For illustrative purposes, in this particular embodiment the ribs 30 are spaced apart from one another by roughly the equivalent of their width. They protrude sufficiently from the otherwise relatively flat surface of the thumb-receiving area 20 to offer satisfactory frictional characteristics, while not protruding too much to avoid causing discomfort for the user. For illustrative purposes, in this embodiment, the ribs are in a number of four, have about ⅛" in width, and a spacing of about ⅛" between adjacent ribs. They protrude by about 1/16" from the otherwise relatively flat surface of the thumb-receiving area. Their length depends of their position along the thumb-receiving area 20, and of the width of the thumb-receiving area 20 at the corresponding position. It varies between about ½" and 1⅛" in length. Further, the ribs are slightly curved along their length to further conform to the anatomy of the thumb.

Many variants are possible. For instance, in alternate embodiments, there could be 3 or 5 ribs instead of 4, a minimum of 2 ribs, or more than 5 ribs. The ribs could have between 0.035 inches and 0.125 inches in thickness for instance. Instead of ribs, the protrusions can be provided in the form of spots for instance. The width and the interspacing between protrusions can vary substantially as well, as long as they offer satisfactory characteristics for the end user. The ribs can be applied to thumb-receiving surfaces of cup-holder trays which greatly depart from the configuration which is shown in the attached figures.

Turning the focus now to the cup pockets 12*a*, 12*b*, 12*c*, 12*d*, each one can be seen to have a system of three cup holding surfaces 32*a*, 32*b*, 32*c* which cooperate in firmly retaining a beverage cup (not shown) which is to be inserted therein from above and placed into abutment against the bottom 34. More particularly, the cup pocket 12*c* can be seen to have an outer wall 36 which is somewhat truncated conical in shape. An imaginary cone 38, coinciding with an axis 40 of the cup holder 12*c* is depicted in dashed lines in FIG. 1 to illustrate this. In this particular embodiment, the outer wall actually includes three wall sections with the cup holding surfaces 32*a*, 32*b*, 32*c* interspersed therebetween. The cup holding surfaces 32*a*, 32*b*, 32*c* protrude inwardly from the outer wall and can resiliently yield when a beverage cup is pushed therein and exert a reactive holding force against the beverage cup which maintains the beverage cup in upright position in the cup pocket 12*c*. The cup holding surfaces 32*a*, 32*b*, 32*c* achieve this function given the fact that they have a lower edge 42 which is free and spaced apart from the bottom 34. In this embodiment, the cup holding surfaces 32*a*, 32*b*, 32*c* are slightly convex along their width 43, but can alternately be flat or slightly concave for instance, and are straight along their length 46. The cup holding surfaces 32*a*, 32*b*, 32*c* are inclined around their upper edge 44 in a manner that the lower edge 42 of the cup holding surfaces 32*a*, 32*b*, 32*c* is radially inward compared to the upper edge 44, relative to the center of the cup pocket 12*c*.

The resilient yielding action of the cup holding surfaces 32*a*, 32*b*, 32*c* can be enhanced by defining a longitudinal slot 48 splitting the cup holding surfaces 32*a*, 32*b*, 32*c* into two lateral halves 50*a*, 50*b* as shown. The longitudinal slot 48 forms an inversed-T shape with the transversal slot 52, or gap, which separates the lower edge of the cup holding surfaces 32*a*, 32*b*, 32*c* from the bottom of the cup pockets. For illustrative purposes, the angle of inclination of the cup holding surfaces 32*a*, 32*b*, 32*c* relative to a vertical orientation is of roughly 30-40 degrees in the embodiment shown in FIGS. 1 to 3. However, one skilled in the art will appreciate that in alternative and non-limitative embodiments, the angle of inclination of the cup holding surfaces 32*a*, 32*b*, 32*c* relative to a vertical orientation can vary between about 15 degrees to about 40 degrees, as it will be described in more details below in reference to FIG. 4

In this embodiment, the cup holding surfaces 32*a*, 32*b*, 32*c* are connected to the outer wall of the cup pocket by lateral walls 54*a*, 54*b*. Further, in this particular case, the cup holding surfaces 32*a*, 32*b*, 32*c* have a free lower edge 56 and are connected to a horizontal flat surface at an upper edge 58 thereof. The lateral walls 54*a*, 54*b* also have a free lower end 56 and are connected to the same horizontal flat surface at an upper end 58 thereof.

It will be noted here that in this particular embodiment, all three cup holding surfaces 32*a*, 32*b*, 32*c* are identical, although it will be understood that they can differ from one another in other embodiments. Further, in the illustrated embodiment, it will be seen that the configuration of the lateral walls 54*a*, 54*b* can differ from one cup holding surface to another. In fact, at each cup pocket, two of the cup holding surfaces 32*b*, 32*c* connect to corresponding thumb receiving areas 20 at their upper end. These cup holding surfaces 32*b*, 32*c* can be referred to as internal cup holding surfaces 32*b*, 32*c*. The other 32*a* of the three cup holding surfaces connects to the rim 14 of the cup holder tray 10 at its upper edge 44. This cup holding surface 32*a* can be referred to as an outer cup holding surface 32*a*. In this embodiment, the configuration of the lateral walls 54*a*, 54*b* somewhat differs between the internal cup holding surfaces 32*b*, 32*c* and the outer cup holding surfaces 32*a* given the particular design of the cup holder tray 10.

Figure 2:
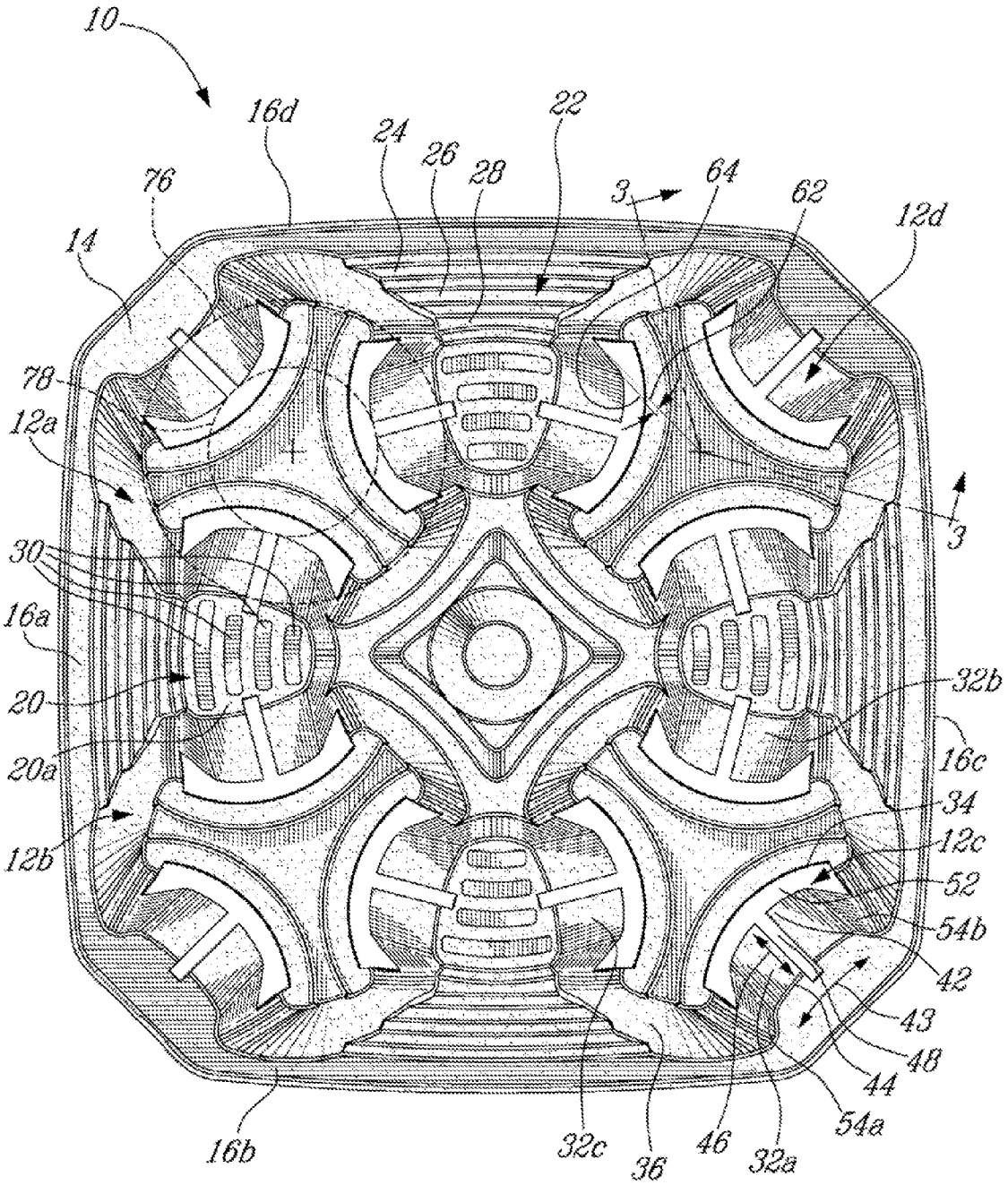
FIG. 2 is a top plan view showing the cup-holder tray of FIG. 1.
Figure 3:
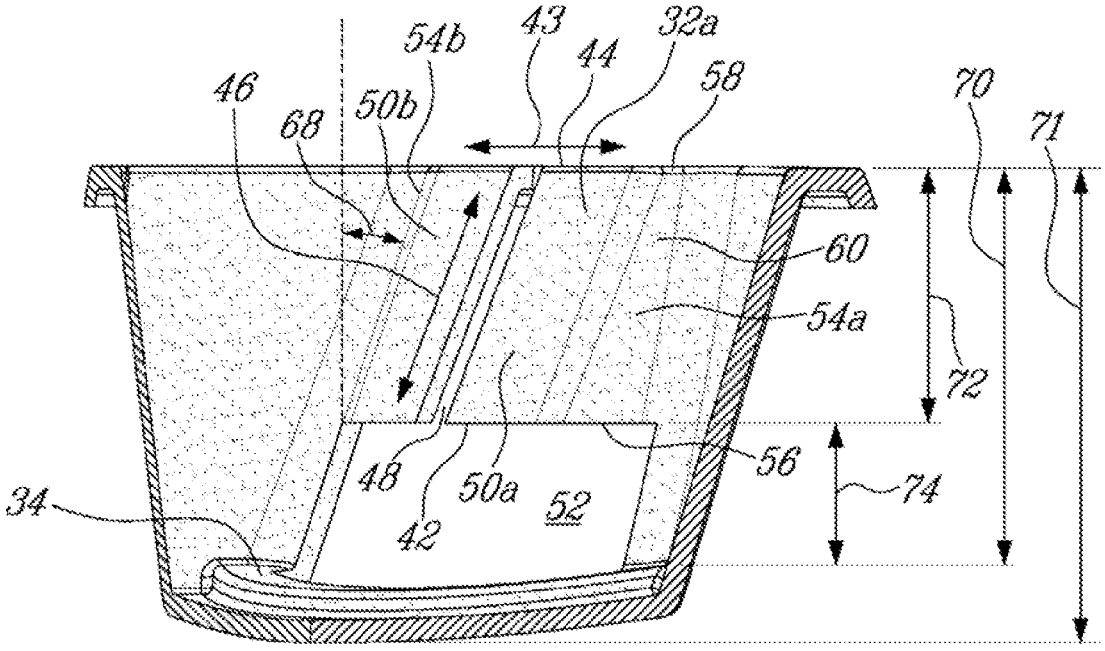
FIG. 3 is a sectional view taken along lines 3-3 of FIG. 2.

One feature which contributes to the resilient yielding feature of the cup holding surfaces 32*a*, 32*b*, 32*c* in this particular embodiment is the presence of the lateral walls 54*a*, 54*b*. More precisely, the lateral walls 54*a*, 54*b* include a flat section 60 which is identified schematically in FIG. 3. This flat section 60 has a free lower edge 56 which is straight, and an upper edge 58 which reaches to the horizontal flat surface interconnecting it to the cup holding surface 32*a*. Moreover, in this particular embodiment, the lower edge 56 is horizontal, i.e. parallel to the plane of the cup holder tray. In FIG. 2, it can be seen that the plane corresponding to the flat section 60 is inclined slightly inwardly relative to an imaginary axis 62 extending radially and horizontally from the center of the cup pocket. For illustrative purposes, this slight inward inclination is of roughly 5 degrees in this particular embodiment (angle between the projection 64 of the horizontal lower edge 56 of the flat section 60 and an imaginary horizontal axis 62 extending radially from the center of the cup pocket 12*d*). When a beverage cup is pushed into the cup pocket, against the bottom, it pushes equally against all of the three cup-holding surfaces 32*a*, 32*b*, 32*c*. Depending on the size of the beverage cup, the pushing by the beverage cup will have a different effect on the cup holding surface. Larger beverage cups will move the cup holding surfaces 32*a*, 32*b*, 32*c* more than smaller beverage cups. In all cases, the two halves 50*a*, 50*b* of the cup holding surfaces, principally in the lower portion thereof, are moved away from one another, the longitudinal slot 48 (or vertical slot) broadening towards the bottom. The free corners adjacent the longitudinal slot 48 on both halves are pushed inwardly. The strongly curved portion interconnecting the cup holding surface 32*a* to the lateral walls 54*a*, 54*b* has a stronger resistance than the free corners to being pushed inwardly because they are held in place by the flat section 60, this exerts a significant portion of the holding force against the beverage cup, including at the area along the height of the cup holding surface where the flat surface is substantially normal to the beverage cup. Although the lower edge 56 of the flat surfaces 60 can be pivoted slightly outwardly upon insertion of the cup (even though they are manufactured inclined slightly inwardly), a portion of the flat surfaces 60 can remain substantially normal to the beverage cup given the fact that the upper edge of the flat surface is connected to the horizontal surface and given the fact that the free lower edge 56 of the flat surfaces 60 are laterally (outwardly, one free lower edge 56 relatively to the other free lower edge 56 associated to one of the cup holding surface 32) inclined around an axis corresponding to the upper edge 58. The inclination of the flat section 60 around the lower edge is illustrated in FIG. 3. For illustrative purposes, in this example, the inclination 68 of the flat sections 60 around their lower edges, relative to the vertical, is of roughly between 15 and 20 degrees, preferably around 18, and the cup holding surface upper edge 44 has roughly the same width as the cup holding surface lower edge 42. The inclination of the cup holding surface 32*a* relative to the vertical is of roughly 35 to 40 degrees, preferably around 38.

For purpose of fully describing an embodiment only, some dimensions of the illustrated example are now given. Referring to FIG. 3, the overall height 71 of the cup holder tray is roughly 2 inches while the height 70 of the cup holder tray between the upper edge 58 and the inner bottom 34 is roughly about ½ inch. The height of the cup holding surface 72 is of roughly 1 inch, whereas the height 74 of the horizontal slot separating the lower edge of the cup holding surfaces from the bottom is of roughly ½ inch. Referring to FIG. 2, the diameter of an imaginary circle 76 reaching the upper end of the longitudinal slots of all cup holding surfaces is of roughly three inches. The diameter 76 is substantially identical to the diameter of imaginary circle reaching a lower edge of the outer walls 36. Whereas the diameter of an imaginary circle 78 reaching the lower end of the longitudinal slots of all cup holding surfaces (when free from beverage cups) is of roughly 1¾ inches. The lower edge of the flat sections are of roughly ⅓ of an inch.

Figure 4:
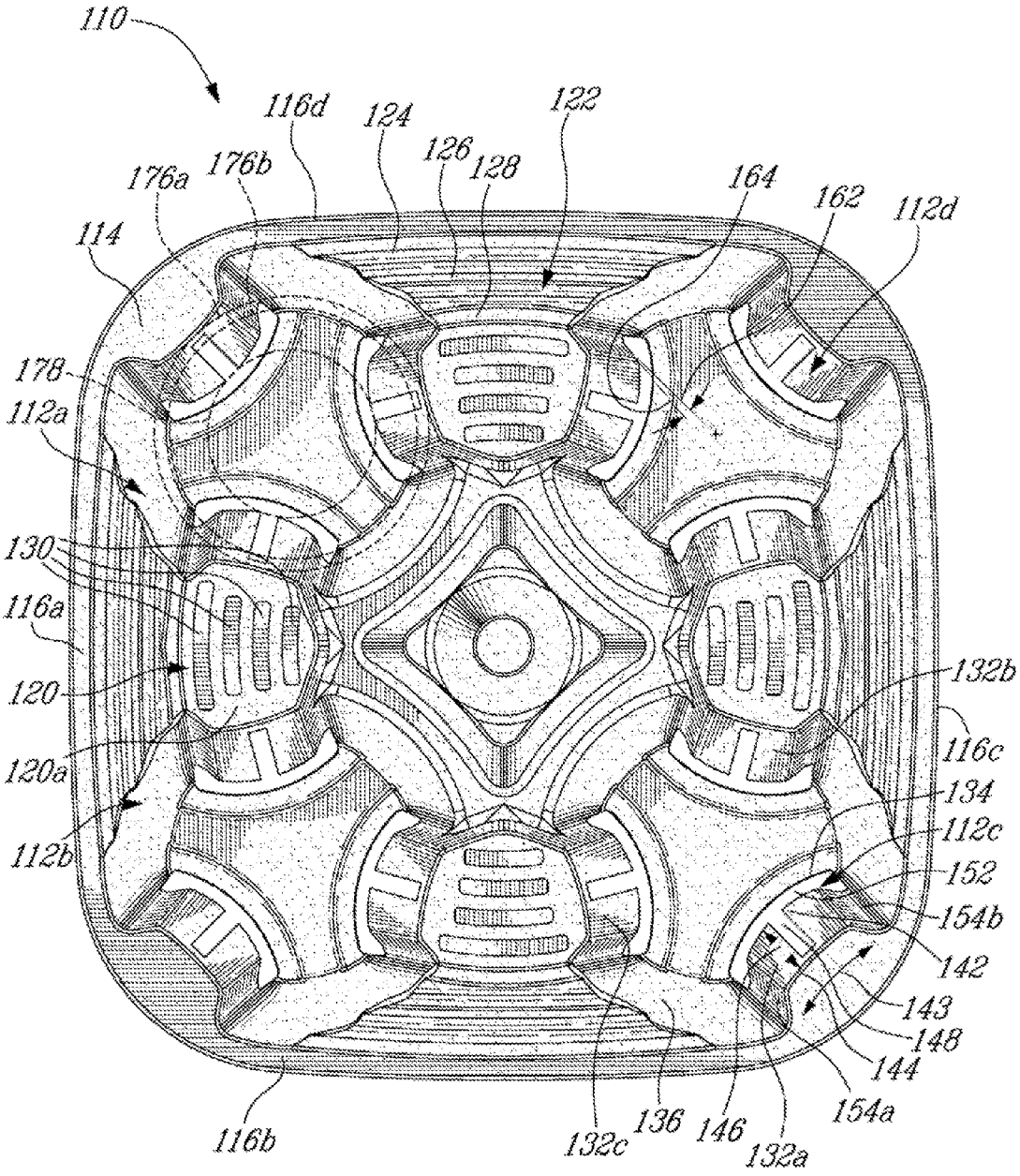
FIG. 4 is a top plan view showing the cup-holder tray in accordance with a second embodiment with deeper cup pockets.

Referring now to FIG. 4, there is shown another embodiment wherein the features are numbered with reference numerals in the 100 series which correspond to the reference numerals of the previous embodiment. The cup-holder tray 110 is designed with four cup pockets 112*a*, 112*b*, 112*c*, 112*d*, the cup pockets 112*a*, 112*b*, 112*c*, 112*d* being deeper than the cup pockets 12*a*, 12*b*, 12*c*, 12*d*. Therefore, cups inserted in the cup pockets 112*a*, 112*b*, 112*c*, 112*d* are supported at a higher position. More particularly, the upper edge 158 of the tray 110 is adjacent to a higher wall position of an inserted cup, thereby increasing the stability of the inserted cup. If instability arises, the lateral wall of the cup abuts at least one of the lateral wall 154 and the upper edge 158 to prevent cup overthrown or spilling of the cup content.

The height 174 of the horizontal slot 152 separating the lower edge of the cup holding surfaces 132 from the bottom 134 is maintained at approximately ½ inch and the diameter of the imaginary circle 178 reaching the lower end of the longitudinal slots 148 of all cup holding surfaces 132 (when free from beverage cups) is of roughly 1¾ inches. However, the height 172 of the cup holding surface 132 and the height 170 are increased to up to 1.7 inches and 2.2 inches respectively.

Furthermore, on the opposite of the above-described embodiment, the imaginary circle 176*a* reaching the upper end of the longitudinal slots 148 of all cup holding surfaces 132 and the imaginary diameter 176*b* reaching the lower edge of the outer walls 136 are not characterized by the same diameter. More particularly, the imaginary circle 176*b* is characterized by a smaller diameter than the imaginary circle 176*a*. In an embodiment, the diameter of the imaginary circle

176*a* ranges between about 2.75 inches and 3.2 inches and the diameter of the imaginary circle 176*a* ranges between about 2.5 and 3 inches. In a non-imitative embodiment, the difference between the diameters of the imaginary circles 176*a*, 176 ranges between about 0 mm (embodiment shown in FIGS. 1 to 3) to 0.4 inch.

The angle of inclination of the cup holding surfaces 132*a*, 132*b*, 132*c* relative to a vertical orientation is of roughly between 15-40 degrees in a non-limitative embodiment. In the embodiment shown in FIG. 4, the angle of inclination of the cup holding surfaces 132*a*, 132*b*, 132*c* ranges between 15 and 25 degrees.

It will be noted that due to the intrinsic features of moulded pulp, actual dimensions typically differ from the dimensions of the mould, due to uneven shrinking and roughness of finished material.

It will be understood that the embodiment description and illustration is provided for illustrative purposes only, from which alternate embodiments can significantly depart. For instance, alternate cup holder trays can have more or less cup pockets, and more than three cup holding surfaces per cup pocket.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope is indicated by the appended claims.

What is claimed is:

1. A cup holder tray having a body of moulded pulp with a plurality of cup pockets for receiving beverage cups therein, and a rim surrounding the plurality of cup pockets, the cup pockets projecting downwardly relative to the rim, each one of the cup pockets having a bottom parallel to the rim, and at least three wall sections extending upwardly from the bottom and at least three cup holding surfaces circumferentially interspersed between the at least three wall sections and protruding inwardly therefrom, the cup holding surfaces cooperating in holding a beverage cup to be pushed downwardly against the bottom, the cup holder tray being characterized in that at least one of the cup holding surfaces is connected to adjacent wall sections on each side by a corresponding lateral wall having a substantially planar section extending between an upper edge and a free lower edge of the corresponding lateral wall.

2. The cup holder tray of claim 1 wherein the planar section is oriented substantially normal to the beverage cup received in a corresponding one of the cup pockets.

3. The cup holder tray of claim 1 wherein each cup holding surface has an upper edge connected to a horizontal surface to which the planar sections of the two corresponding lateral walls are also connected.

4. The cup holder tray of claim 1 wherein the cup holding surfaces have a free lower edge separated from the bottom by a gap extending under their entire width and being contiguous with the free lower edge of adjacent ones of the lateral walls and the height of cup holding surfaces is greater than height of the gap and the cup holding surfaces are split into two halves by a slot extending upwardly from the gap.

5. The cup holder tray of claim 1 wherein the cup holding surfaces are inwardly inclined relative to an upper edge and define an angle of inclination ranging between 15 and 40 degrees.

6. The cup holder tray of claim 1 wherein the free lower edge of a corresponding one of the planar sections is outwardly inclined relative to the corresponding one of the upper edges.

7. The cup holder tray of claim 1 wherein the wall sections connect the bottom to a horizontal surface at the height of the rim.

8. The cup holder tray of claim 1 wherein all the cup holding surfaces are connected by the lateral walls having a substantially planar section.

9. A cup holder tray having a plurality of cup pockets for receiving beverage cups therein, each one of the cup pockets having an outer periphery and a bottom and at least three cup holding surfaces protruding inwardly from the outer periphery and cooperating in holding a beverage cup which is inserted into the cup pocket and placed into abutment against the bottom, the cup holding surfaces having a free lower edge being inwardly inclined relative to an upper edge, and being resilient in a manner to be pushed outwardly by the beverage cup as it is inserted into the cup pocket and thereafter exert a reactive pushing force against the positioned beverage cup; the cup holder tray being characterized in that each one of the at least three cup holding surfaces has two opposite lateral walls on each side thereof, and that the lateral walls have a substantially flat section which is substantially normal to the beverage cup when inserted in the cup pocket.

10. The cup holder tray of claim 9 wherein the flat sections each have a free lower edge outwardly inclined relative to an upper edge.

11. The cup holder tray of claim 10 wherein the free lower edge is oriented slightly inwardly relative to the center of the cup pocket, the orientation of the free lower edge being moved slightly outwardly relative to the center of the cup pocket when the beverage cup is inserted in the cup pocket and the free lower edge of the flat sections are oriented horizontally.

12. The cup holder tray of claim 10 wherein the upper edge of cup holding surfaces and the upper edge of flat section are connected to a common horizontal surface.

13. The cup holder tray of claim 9 wherein outer periphery of the cup pockets interconnects the bottom to a rim of cup holder tray.

14. The cup holder tray of claim 9 wherein the cup holding surfaces are split into two halves by a vertical slot.

15. The cup holder tray of claim 9 wherein the height of cup holding surfaces is greater than a height separating lower edge of the cup holding surfaces from the bottom and the height of cup holding surfaces is at least twice the height separating lower edge of the cup holding surfaces from the bottom.

16. The cup holder tray of claim 9 wherein the cup holding surfaces are inclined inwardly relative to the upper edge by more than 15 degrees and the flat section is inclined relative to its upper edge by more than 10 degrees.

17. A cup holder tray comprising a body made of moulded pulp having four cup pockets projecting downwardly relative to the rim, four edges and four corners, each one of the cup pockets being positioned adjacent a corresponding one of the corners and having a bottom parallel to the rim, and at least three wall sections extending upwardly from the bottom and at least three cup holding surfaces circumferentially interspersed between the at least three wall sections, protruding inwardly therefrom, and connected thereto by lateral walls on both sides, the cup holding surfaces cooperating in holding a beverage cup pushed downwardly against the bottom of the corresponding cup pocket; and adjacent each one of the edges, a corresponding spacing provided underneath the tray between two corresponding ones of the pockets, in which a user can place his fingers and support the tray; and above each one of the spacings, above the tray, a corresponding thumb-receiving surface against which the user can apply his thumb, in opposition with his fingers in the corresponding spacing; wherein for each one of the four cup pockets, one of the cup holding surfaces is an outer holding surface and has an upper end connected to the rim and lateral walls on both sides connecting the outer holding surface to the wall sections, and two of the cup holding surfaces are inner holding surfaces having an upper end connected to a corresponding thumb receiving surface; wherein at least one of the cup holding surfaces is connected to adjacent wall sections on each side by a corresponding lateral wall having a substantially planar section extending between an upper edge and a free lower edge of the corresponding lateral wall.

18. The cup holder tray of claim 17 wherein the outer holding surface is connected to adjacent wall sections on each side by corresponding lateral walls each having a substantially planar section.

19. The cup holder tray of claim 17 wherein all of the cup holding surfaces are connected to adjacent wall sections on each side by corresponding lateral walls each having a substantially planar section and all of the cup holding surfaces are split into two halves by a vertical slot.

20. The cup holder tray of claim 17 wherein the planar sections are substantially normal to the beverage cup and are straight along their length, inclined towards the beverage cup, with the upper edge being connected to a horizontal surface.

21. A cup holder tray having a plurality of cup pockets for receiving beverage cups therein, each one of the cup pockets having a circular wall and at least three cup holding surfaces protruding inwardly from the circular wall and cooperating in holding a beverage cup to be pushed downwardly therein, the cup holder tray being characterized in that at least one of the cup holding surfaces is connected to the circular wall by a lateral wall on each side, the lateral walls having a planar section oriented roughly normal to the beverage cup during use.

22. A cup holder tray comprising a body made of moulded pulp, having four edges and four corners, and four cup pockets, each cup pocket having a circular wall and at least three cup holding surfaces protruding inwardly from the circular wall and cooperating in holding a beverage cup to be pushed downwardly therein and being positioned adjacent a corresponding one of the corners; and adjacent each one of the edges, a corresponding spacing provided underneath the tray, between two corresponding ones of the pockets, in which a user can place his fingers and support the tray; and above each one of the spacings, above the tray, a corresponding thumb-receiving surface against which the user can apply his thumb, in opposition with his fingers in the corresponding spacing, the thumb-receiving surface extending between the two corresponding ones of the cup pockets and being connected to an upper end of at least one of the cup holding surfaces of each one of the two corresponding ones of the cup pockets; wherein the moulded pulp body has a sufficient amount of structural resistance to maintain its structural integrity when four beverages are inserted into corresponding ones of the four cup pockets and the tray with the beverages are being carried by the thumb and fingers of the user; characterized in that the thumb receiving surface has a plurality of upwardly protruding ribs providing frictional engagement for the thumb.

23. The cup holder tray of claim 22 wherein the ribs are elongated, parallel to one another, and parallel to the corresponding edge.

24. The cup holder tray of claim 22 wherein the ribs protrude upwardly by between 0.050 and 0.125 inches.

25. The cup holder tray of claim 22 wherein the ribs are equally interspaced from one another and by a distance corresponding to their width.

26. The cup holder tray of claim 22 wherein the thumb-receiving surface is spaced from the edge.

27. The cup holder tray of claim 22 wherein a structural portion having a plurality of steps oriented parallel to the edge is provided between the thumb-receiving surface and the edge of the tray.

28. A cup holder tray having a plurality of cup-holding pockets projecting downwardly from the tray, and at least one lateral edge adjacent two of the cup-holding pockets, each cup-holding pocket having a circular wall and at least three cup holding surfaces protruding inwardly from the circular wall and cooperating in holding a beverage cup to be pushed downwardly therein, the two of the cup-holding pockets being spaced apart from one another along the edge, with a finger spacing therebetween configured for receiving fingers of a user underneath the tray, and a thumb-receiving surface above the finger spacing and spaced from the edge, configured for receiving a thumb of the user above the tray, in opposition with the fingers, the thumb-receiving surface extending between the two of the cup-holding pockets and being connected to an upper end of at least one of the cup holding surfaces of each one of the two of the cup-holding pockets, the thumb-receiving surface having a plurality of upwardly oriented protrusions.

29. The cup holder tray of claim 28 wherein the protrusions are elongated ribs disposed parallel to one another and parallel to the corresponding edge.

30. A cup holder tray having a plurality of downwardly projecting cup pockets, a finger spacing provided between two cup pockets, and a thumb-receiving surface above the finger spacing, each of the cup pockets having a circular wall and at least three cup holding surfaces protruding inwardly from the circular wall and cooperating in holding a beverage cup to be pushed downwardly therein and the thumb-receiving surface extending between the two cup pockets and being connected to an upper end of at least one of the cup holding surfaces of each one of the two cup pockets, the thumb receiving portion having at least three upwardly oriented protrusions providing frictional engagement for the thumb.

* * * * *